US010254005B2

(12) United States Patent
Mao et al.

(10) Patent No.: US 10,254,005 B2
(45) Date of Patent: Apr. 9, 2019

(54) INDOOR UNIT OF AIR CONDITIONER

(75) Inventors: Xianyou Mao, Beijiao (CN); Yang Liu, Beijiao (CN); Ming Wan, Beijiao (CN); Xiaodeng Xia, Beijiao (CN)

(73) Assignee: GD MIDEA AIR-CONDITIONING EQUIPMENT CO., LTD., Foshan (CN)

( * ) Notice: Subject to any disclaimer, the term of this patent is extended or adjusted under 35 U.S.C. 154(b) by 674 days.

(21) Appl. No.: 14/424,337

(22) PCT Filed: Aug. 28, 2012

(86) PCT No.: PCT/CN2012/080670
§ 371 (c)(1),
(2), (4) Date: Mar. 30, 2015

(87) PCT Pub. No.: WO2014/032229
PCT Pub. Date: Mar. 6, 2014

(65) Prior Publication Data

US 2015/0219359 A1 Aug. 6, 2015

(51) Int. Cl.

| | |
|---|---|
| ***F24F 1/00*** | (2019.01) |
| ***F24F 13/20*** | (2006.01) |
| ***F24F 1/0011*** | (2019.01) |
| ***F24F 13/10*** | (2006.01) |

(Continued)

(52) U.S. Cl.
CPC ..... *F24F 13/20* (2013.01); *F24F 1/0011* (2013.01); *F24F 13/10* (2013.01); *F24F 13/12* (2013.01); *F24F 13/14* (2013.01); *F24F 2001/0037* (2013.01); *F24F 2001/0074* (2013.01); *F24F 2013/1446* (2013.01); *F24F 2013/205* (2013.01)

(58) Field of Classification Search
CPC .. F24F 13/10; F24F 13/12; F24F 13/14; F24F 13/20; F24F 1/0011; F24F 2001/0037; F24F 2001/0074; F24F 2013/1446; F24F 2013/205
USPC ..... 454/249, 333, 358; 165/218
See application file for complete search history.

(56) References Cited

U.S. PATENT DOCUMENTS

| | | | | |
|---|---|---|---|---|
| 3,766,750 A * | 10/1973 | Aoh | F24F 1/02 62/259.1 |
| 2009/0098820 A1* | 4/2009 | Yabu | F24F 1/0011 454/333 |
| 2009/0241576 A1* | 10/2009 | Tsuji | F24F 1/0007 62/259.1 |

FOREIGN PATENT DOCUMENTS

| | | |
|---|---|---|
| CN | 101421563 | 4/2009 |
| CN | 202835569 | 3/2013 |
| EP | 1947397 | 7/2008 |

(Continued)

OTHER PUBLICATIONS

WIPO, International Search Report for PCT/CN2012/080670, dated May 23, 2013.

*Primary Examiner* — Gregory L Huson
*Assistant Examiner* — Dana K Tighe
(74) *Attorney, Agent, or Firm* — Hodgson Russ LLP

(57) ABSTRACT

An indoor unit of an air conditioner includes a casing (1) defining a receiving cavity (10), a heat exchanger (2) and a fan (3) disposed in the receiving cavity (10) respectively, and a panel (4) disposed on a bottom of the casing (1). The panel (4) is movable between a close position in which both an air inlet (11) and an air outlet (12) of the receiving cavity (10) are closed and an open position in which both the air inlet (11) and the air outlet (12) are open. In the open position, the panel (4) at least partially separates the air (Continued)

entering via the air inlet (11) from the air exiting via the air outlet (12).

19 Claims, 8 Drawing Sheets

(51) Int. Cl.
*F24F 13/12* (2006.01)
*F24F 13/14* (2006.01)

(56) References Cited

FOREIGN PATENT DOCUMENTS

| | | | | | |
|---|---|---|---|---|---|
| GB | 1147282 | A * | 4/1969 | ..... | F24F 13/12 |
| JP | H0420923 | | 2/1992 | | |
| JP | 2005098671 | | 4/2005 | | |
| JP | 2007155309 | | 6/2007 | | |
| JP | WO 2011007520 | A1 * | 1/2011 | ..... | F24F 1/0011 |
| WO | 2009044830 | | 4/2009 | | |

* cited by examiner

INDOOR UNIT OF AIR CONDITIONER

CROSS-REFERENCE TO RELATED APPLICATION

This U.S. application claims priority under 35 U.S.C. 371 to, and is a U.S. National Phase application of, the International Patent Application No. PCT/CN2012/080670, filed Aug. 28, 2012. The entire content of the above-mentioned patent application is incorporated by reference as part of the disclosure of this U.S. application.

FIELD

The present disclosure relates to an air conditioner field, and more particularly to an indoor unit of an air conditioner.

BACKGROUND

An indoor unit of an air conditioner of the ceiling type is generally mounted on the ceiling of a room, with an air outlet and an air inlet disposed on the bottom of a casing of the indoor unit. Accordingly, air may return from the room below to the indoor unit via the air inlet, and be blown to the room via the air outlet. Due to the limited size of the indoor unit, the distance between the inlet 12 and the outlet is small and it is possible that partial blown air is drawn by the air inlet, thus causing a mixing of the blown air and the intake air. In particular, in a heating operation, heated air exiting via the air outlet is relatively lighter and tends to rise, and therefore is hard to be delivered to areas near the ground.

In order to deliver the heated air to areas near the ground, it is required to increase the air blowing speed and the static pressure so as to make the air blowing direction as vertical as possible. The heated air discharged via the air outlet in this condition, however, is much easier to be drawn by the air inlet, thus causing a mixing of the blowing air and the intake air much easier. Therefore, providing an indoor unit of an air conditioner of the ceiling type which can improve both the air blowing range and air blowing effect (especially improving air blowing effect in the heating operation) and reduce the mixing of the blown air and the intake air become a problem to be solved.

SUMMARY

The present disclosure seek to solve at least one of the problems existing in the prior art. Accordingly, an object of the present disclosure is to provide an indoor unit of an air conditioner with a better air blowing effect.

The indoor unit of an air conditioner according to embodiments of the present disclosure includes: a casing defining a receiving cavity therein, the receiving cavity having an air inlet and an air outlet formed in a bottom of the receiving cavity and spaced apart from each other; a heat exchanger disposed in the receiving cavity and adjacent to the air inlet so as to perform heat exchanging with an air flow entering the receiving cavity via the air inlet; a fan disposed in the receiving cavity; and a panel disposed on a bottom of the casing and movable between a close position and an open position, where in the close position, the panel closes both the air inlet and the air outlet; in the open position, the panel opens both the air inlet and the air outlet, and at least partially separates air entering via the air inlet from air exiting via the air outlet.

With the indoor unit of an air conditioner according to embodiments of the present disclosure, by using the panel moveable between the close position and the open position, the air inlet and the air outlet are closed when the indoor unit is not operating, thus providing the indoor unit with an aesthetic appearance and preventing dusts from entering into the indoor unit. In addition, it may prevent cooled air or heated air output via the air outlet from returning to the indoor unit and mixing with the intake air, thus avoiding a loss of cooling capacity or heating capacity and providing a better air blowing effect.

In addition, the indoor unit of an air conditioner according to embodiments of the present disclosure has the following technical features.

According to an embodiment of the present disclosure, in the open position, a first end of the panel abuts against a spacing portion between the air inlet and the air outlet, a second end of the panel is inclined downwards, and an angle $\alpha$ between a plane in which the panel lies and a horizontal plane in which a bottom surface of the casing lies ranges from 15° to 150°.

Thereby, under a guide action of the panel on the air flow, the air blowing effect of the indoor unit of the air conditioner according to embodiments of the present disclosure may not be influenced. Further, it may prevent the cooled air or heated air which is newly blown out from being drawn back by adjacent air inlet(s), prevent the cooled air or heated air from mixing with the intake air, and avoid the loss of cooling capacity and heating capacity. In addition, air blowing speed and air blowing distance at the air outlet side may be changed by changing the angle of the panel with respect to the casing, thus providing users with more comfort.

In an embodiment, the angle $\alpha$ between the plane in which the panel in the open position lies and the horizontal plane in which the bottom surface of the casing lies ranges from 40° to 140° when the air conditioner is in a heating operation.

In an embodiment, the angle $\alpha$ between the plane in which the panel in the open position lies and the horizontal plane in which the bottom surface of the casing lies ranges from 15° to 75° when the air conditioner is operating with small air volume.

Alternatively, the panel is swayable within a range defined by the angel $\alpha$. Thereby the air blowing angle and the air blowing range may be adjusted continuously.

Alternatively, the panel is held in a position at which the angle $\alpha$ has a predetermined value when the panel is in the open position.

The indoor unit of an air conditioner further includes an air guide swayably disposed at the air outlet and configured to guide the air exiting via the air outlet. When the panel is in the open position, the air guide cooperates with the panel so as to blow air to a larger blowing range.

In an embodiment of the present disclosure, the indoor unit of an air conditioner further includes a driving device disposed between the panel and the casing and configured to drive the panel to move between the close position and the open position.

In an embodiment of the present disclosure, the driving device includes: a first driving assembly disposed between the panel and the casing and configured to drive the panel to translate to a predetermined position, and a second driving assembly disposed between the panel and the casing and configured to drive the panel to rotate.

In an embodiment of the present disclosure, the first driving assembly includes: a first rack disposed on the panel, and a first gear disposed on the casing and configured to mesh with the first rack so as to drive the panel to translate with respect to the casing.

In an embodiment of the present disclosure, the second driving assembly includes: an arc rack disposed on the panel, and a second gear disposed on the casing and configured to mesh with the arc rack so as to drive the panel to rotate with respect to the casing.

Alternatively, the second driving assembly drives the panel to rotate at the same time as the first driving assembly drives the panel to translate.

In an embodiment of the present disclosure, the first driving assembly includes: a driving belt pulley disposed on the casing, and a belt configured to cooperate with the driving belt pulley so as to drive the panel to translate with respect to the casing.

In an embodiment of the present disclosure, the second driving assembly includes: a driving gear disposed on the casing, and a gear train disposed on the panel and configured to mesh with the driving gear so as to drive the panel to rotate with respect to the casing.

Alternatively, the second driving assembly drives the panel to rotate at the same time as the first driving assembly drives the panel to translate.

With the indoor unit of the air conditioner according to embodiment of the present disclosure, by applying the first driving assembly and the second driving assembly, the translation and angle development of the panel may be achieved efficiently and rapidly, and the indoor unit has simple structure.

In another embodiment of the present disclosure, the driving device includes: a guide plate connected to the panel and having an arc sliding passage therein, and a slider disposed on the casing and slidable in the arc sliding passage so as to define a movement track of the guide plate and to drive the panel to move between the close position and the open position.

An outer gear rim is formed at an outer edge of the guide plate; the driving device further includes a driving gear disposed on the casing and configured to mesh with the outer gear rim; and the panel is moveable between the close position and the open position under cooperation between the slider and the arc sliding passage and cooperation between the driving gear and the outer gear rim.

According to an embodiment of the present disclosure, the casing defines two symmetry receiving cavities therein, each receiving cavity has an air inlet and an air outlet spaced from each other and formed in the bottom of the receiving cavity; and the indoor unit includes two heat exchangers disposed in the two receiving cavities respectively, two fans disposed in the two receiving cavities respectively, at least two panels disposed symmetrically on the bottom of the casing, and each panel is movable between a close position in which one corresponding air inlet and one corresponding air outlet are both closed by the panel and an open position in which the one corresponding air inlet and the one corresponding air outlet are both open.

According to an embodiment of the present disclosure, the receiving cavity includes one air outlet, the indoor unit includes one panel, the panel is configured to translate towards an air inlet side from the close position to a spacing position, then to rotate to the open position, and an end of the panel is located below a spacing portion between the air inlet and the air outlet when the panel is in the spacing position.

According to an embodiment of the present disclosure, the receiving cavity includes a plurality of air outlets disposed at at least two ends of the bottom of the casing; and the indoor unit includes a plurality of panels, each panel is disposed at the bottom of the casing and between one corresponding air outlet and one corresponding air inlet, the air inlet and air outlets are closed by the panels respectively when the panels are in the close positions, and the air inlet and the air outlets are opened by the panels respectively when the panels are in the open positions.

With the indoor unit of an air conditioner according to embodiments of the present disclosure, the panel may be driven by the driving device, such that the panel may be held with a determined angle with respect to the casing at the spacing portion between the air outlet and the air inlet. The present disclosure has the following advantages: 1) by closing the air inlet and the air outlet by the panel when the indoor unit is not operating, providing the indoor unit an aesthetic appearance and preventing dusts from entering the interior of the indoor unit; 2) preventing cooled air or heated air from returning to the indoor unit or mixing with the intake air, and avoiding the loss of cooling capacity or heating capacity; 3) providing more efficient air blowing effect under the cooperation of the air guide; and 4) increasing an air blowing speed and a static pressure in the heating operation.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference to the accompanying drawings, in which.

REFERENCE NUMERALS

Figure 1:
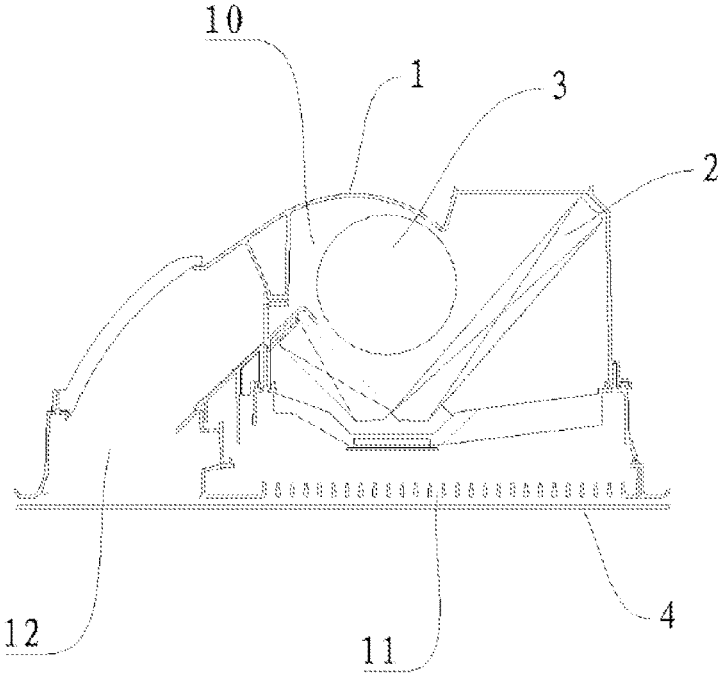
FIG. 1 is a schematic view of an indoor unit of an air conditioner according to an embodiment of the present disclosure, in which the panel is in a close position.

1: casing; 10: receiving cavity; 11: air let; 12: air outlet;
2: heat exchanger; 3: fan; 4: panel; 5: air guide;
6: first driving assembly; 61: first rack; 62: first gear;
7: second driving assembly; 71: arc rack; 72: second gear;
81: guide plate; 811: arc sliding passage; 812: outer gear rim;
82: slider; 83: driving gear;
9: spacing portion.

DETAILED DESCRIPTION

Reference will be made in detail to embodiments of the present disclosure. The same or similar elements and the elements having same or similar functions are denoted by like reference numerals throughout the descriptions. The embodiments described herein with reference to drawings are explanatory, illustrative, and used to generally understand the present disclosure. The embodiments shall not be construed to limit the present disclosure.

In the specification, it should be understood that, the terms such as "central", "longitudinal", "lateral", "width", "thickness", "above", "below", "front", "rear", "right", "left", "vertical", "horizontal", "top", "bottom", "inner", "outer", "clockwise", "counter-clockwise" should be construed to refer to the orientation as then described or as shown in the drawings. These terms are merely for convenience and concision of description and do not alone indicate or imply that the device or element referred to must have a particular orientation. Thus, it cannot be understood to limit the present disclosure. In addition, terms such as "first" and "second" are used herein for purposes of description and are not intended to indicate or imply relative importance or significance or impliedly indicate quantity of the technical feature referred to. Thus, the feature defined with "first" and "second" may comprise one or more this feature. In the description of the present disclosure, "a plurality of" means two or more than two this features, unless specified otherwise.

In the present invention, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

An indoor unit of an air conditioner according to an embodiment of the present disclosure will be described below with reference to FIGS. 1-11. The indoor unit of the air conditioner may be of the ceiling type, for example, an indoor unit connected to the ceiling of a room by a connector, which can be suspended below the ceiling, inserted into the ceiling, or inserted into the ceiling by half.

As shown in FIG. 1, an indoor unit of an air conditioner according to an embodiment of the present disclosure includes a casing 1, a heat exchanger 2, a fan 3 and a panel 4. The casing 1 defines a receiving cavity 10 therein, and the receiving cavity 10 has an air inlet 11 and an air outlet 12 formed in the bottom of the receiving cavity 10 and spaced apart from each other.

The heat exchanger 2 is disposed in the receiving cavity 10 and adjacent to the air inlet 11 so as to perform heat exchanging with air low entering the receiving cavity 10 via the air inlet 11. The fan 3 is disposed in the receiving cavity 10 and brings air flow to the receiving cavity 10 via the air inlet 11, and the air flow through the heat exchanger 2 and the fan 3 is blown out via the air outlet 12.

The panel 4 is disposed on the bottom of the casing 1, and the panel 4 is movable between a close position in which both the air inlet 11 and the air outlet 12 are closed by the panel 4 and an open position in which both the air inlet 11 and the air outlet 12 are open. In the open position, the panel at least partially separates the air entering via the air inlet 11 from the air exiting via the air outlet 12.

Thereby, in other words, when the indoor unit of the air conditioner is not operating, the panel 4 is in the close position and both the air inlet 11 and the air outlet 12 are closed by the panel 4, thus providing the indoor unit an aesthetic appearance and preventing dusts from entering into the receiving cavity. When the indoor unit of the air conditioner is operating, the panel 4 moves to the open position and the air inlet 11 and the air outlet 12 are separated from each other at least by the panel 4. In other words, the air blown out via the air outlet 12 may not be easily drawn into the receiving cavity 10 via the air inlet 11, thus avoiding a mixing of the blown air and the intake air.

With the indoor unit of the air conditioner according to embodiments of the present disclosure, by using the panel moveable between the close position and the open position, the air inlet and the air outlet are closed when the indoor unit is not operating, thus providing the indoor unit an aesthetic appearance and preventing dusts from entering into the interior of the indoor unit. In addition, when the indoor unit is operating, it may prevent cooled air or heated air blown out via the air outlet from returning into the indoor unit and mixing with the intake air, thus avoiding a loss of the cooling capacity or heating capacity and providing a better air blowing effect.

Figure 11:
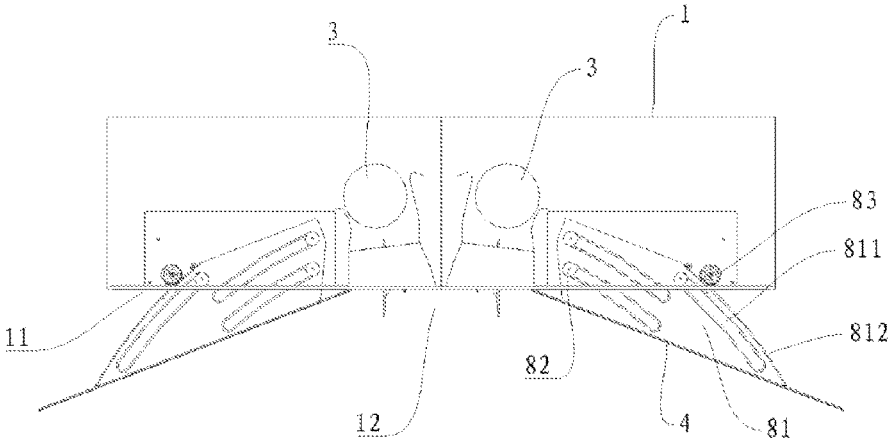
FIG. 11 is a schematic view of an indoor unit of an air conditioner according to yet another embodiment of the present disclosure, in which the panel is in an open position and the casing defines symmetry receiving cavities therein.

In the above and below description, the indoor unit of the air conditioner is described by an example in which the casing defines one receiving cavity therein. However, the present disclosure is not limited to this example. In an alternative embodiment of the present disclosure, the casing defines two symmetry receiving cavities therein, and has two heat exchangers, two fans and at least two panels therein. As shown in FIG. 11, an air inlet and an air outlet spaced apart from the air inlet are formed at the bottom of every receiving cavity. The two heat exchangers are disposed in the two receiving cavities respectively, the two fans are disposed in the two receiving cavities respectively, the at least two panels are disposed symmetrically on the bottom of the casing, and each panel is moveable between the close position in which one corresponding air inlet and one corresponding air outlet are both closed and the open position in which the one corresponding air inlet and the one corresponding air outlet are both open.

In some embodiments of the present disclosure, the receiving cavity 10 defines one air outlet 12, the indoor unit includes one panel 4. The panel 4 can translate towards the air inlet 11 side from the close position to a spacing position, and rotate to the open position. When the panel 4 is in the spacing position, an end of the panel 4 abuts against a lower surface of a spacing portion 9 between the air inlet 11 and the air outlet 12, as shown in FIGS. 1-2 and 6-10. Those with ordinary skill in the art is appreciated that, the present disclosure is not limited to these embodiments, for example, the indoor unit may include two or more air outlets and two or more corresponding panels. In further embodiments of the present disclosure, the receiving cavity 10 defines a plurality of air outlets disposed at at least two ends of the bottom of the casing 1, the indoor unit includes a plurality of panels each disposed on the bottom of the casing and between one corresponding air inlet and one corresponding air outlet (not shown in the drawings). When the panels 4 are in close positions, the air inlet and air outlets are closed; when the panels are in open positions, the air inlet and the air outlets are open.

In the following description, embodiments are described with an example in which the receiving cavity defines one air inlet and one air outlet and the indoor unit includes one corresponding panel. Specifically, during the movement of the panel 4 from the close position to the open position, the movement includes a translation from the close position to the spacing position and a rotation from the spacing position to the open position. The panel 4 moves towards the air inlet 11 side from the close position (as shown in FIG. 1) to the spacing position (not shown in drawings), and then rotates to the open position. When the panel 4 is in the spacing position, an end of the panel 4 is positioned below the spacing portion 9 between the air inlet 11 and the air outlet 12.

According to some embodiments of the present disclosure, when the panel 4 is in the open position, a first end of the panel 4 abuts against the spacing portion 9 between the air inlet 11 and the air outlet 12, and a second end of the panel 4 is inclined downwards, and an angle α between a plane in which the panel 4 lies and a horizontal plane in which a lower surface of the casing 1 lies ranges from 15° to 150°. During the movement of the panel 4 from the close position to the spacing position, the panel 4 moves along a direction from the air outlet 12 to the air inlet 11, after moving to the spacing position, i.e. an end of the panel 4 abuts against the lower surface of the spacing portion 9, the other end of the panel 4 distant from the spacing portion 9 rotates away from the air inlet 11. As indicated in examples shown in FIGS. 1-11, the air inlet 11 is at the right side of the bottom of the casing 1, while the air outlet 12 is at the left side of the bottom of the casing 1. In such case, the movement of the panel 4 includes a translation from left to right, and a rotation in which the left end of the panel abuts against the bottom of the spacing portion 9 and the right end of the panel implements a clockwise rotation.

Thereby, after the panel 4 moves to the open position, the air inlet 11 and the air outlet 12 are separated by the panel 4, air flow can be drawn into the interior of the indoor unit via the air inlet 11 with the panel 4 held in an open angle. During an air blowing process, the panel 4 abuts against the spacing portion between the air inlet 11 and the air outlet 12, thereby preventing air blown out via the air outlet 12 from returning into the interior of the indoor unit via the air inlet 11. Because the panel 4 prevents the blown air from diffusion, an air flow with relatively higher flow rate may be formed along the panel, which is beneficial for blowing the air flow by a greater distance along the direction of the panel 4. Even though partial blown air may enter via the air inlet at the other side of the panel 4, the temperature of the air in the air inlet 11 may not be changed due to a far distance between the blown air and the air inlet 11 and a mixing between the blown air and the environmental air. In this way, the air blowing effect may not be influenced. Further, it prevents the cooled air or heated air newly blown out from being drawn back by adjacent air inlet(s) 11, thus preventing the cooled air or heated air from mixing with the intake air, and thus avoiding a loss the cooling capacity or the heating capacity.

Figure 3:
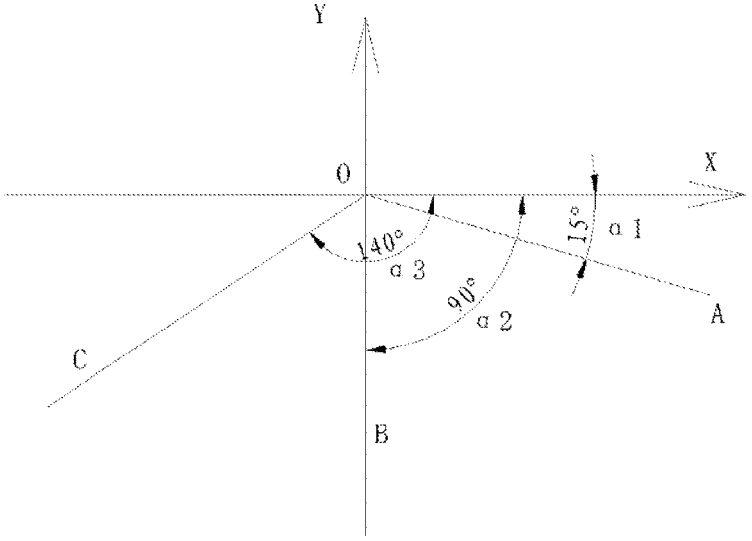
FIG. 3 is a schematic view showing an angle range of a panel of an indoor unit of an air conditioner according to an embodiment of the present disclosure, in which the panel is in an open position.

In order to describe more clearly, as shown in the coordinate system in FIG. 3, axis X represents a horizontal direction, while axis Y represents a vertical direction, these two axes are joint at coordinate origin O, lines OA, OB, and OC represents position directions of three panels 4 respectively, and the coordinate origin O represents the intersection between the panel 4 and the lower surface of the spacing portion 9. If it is defined axis X has an angle of zero and a line rotating from the axis X along the clockwise direction achieves a positive angle value, the angle α1 of line OA, the angle α2 of line OB and the angle α3 of line OC has values of ∠XOA=15°, ∠XOB=90° and ∠XOC=140°. The angle α between the panel 4 and the horizontal direction ranges from 15° to 150°.

In addition to the above technical effect by using different angles α, additional technical effects may be brought by changing the angle α. If it is required to broaden the air blowing range and to reduce temperature of air at the air inlet 11 side, the cooled air may be blown to the largest area by changing the angle α; meanwhile, due to the separation of the panel 4, the air blowing speed and air blowing distance at the panel 4 side may be increased, thus providing a user with improved comfort. If it is required to blowing air in a specific direction, for example, blowing cooled air to a distant area at the air outlet 12 side, alternatively the angle α may be 140°, such that substantially all cooled air may be blown out to the distant area at the air outlet 12 side. In this way, the air blowing speed is high and the air blowing distance is large, which provides a better cooling effect. In addition, the cooled air may not be blown to other areas, thus improving the utilization of the air conditioner.

Alternatively, when the air conditioner is in a heating operation, the angle α between the plane in which the panel 4 in the open position lies and the horizontal plane in which the lower surface of the casing 1 lies ranges from 40° to 140°. Alternatively, when the air conditioner is operating with small air volume, the angle α between the plane in which the panel 4 in the open position lies and the horizontal plane in which the lower surface of the casing 1 lies ranges from 15° to 75°.

In some embodiments of the present disclosure, the panel 4 is swayable within the range defined by the angle α. In other words, when the panel 4 is in the open position, the panel 4 acts as an air guiding component, and the angle α between the panel 4 and the horizontal plane in which the lower surface of the casing 1 lies is adjustable. The panel 4 can sway in the range defined by the angle α so as to adjust the air blowing angle and the air blowing range. Certainly, the present disclosure is not limited to this embodiment. In further embodiments of the present disclosure, when the panel 4 is in the open position, the panel 4 is held in a position at which the angle α has a predetermined value. In other words, when the indoor unit of the air conditioner is operating, the panel 2 is held with a predetermined angle between the panel 4 and the lower surface of the casing 4, and the predetermined angle is maintained.

Alternatively, the indoor unit of the air conditioner according to a further embodiment of the present disclosure further includes an air guide 5. The air guide 5 is disposed swayably at the air outlet 12 and configured to guide the air exiting via the air outlet 12. When the panel 4 is in the open position, the air guide 5 cooperates with the panel 4 so as to guide blown air to a larger area.

Specifically, the indoor unit of the air conditioner further includes a driving device. The driving device is disposed between the panel 4 and the casing 1 so as to drive the panel 4 to move between the close position and the open position.

The driving device and the indoor unit of the air conditioner according to embodiments of the present disclosure may be described below in detail in several embodiments with reference to FIGS. 1-11. By way of example, the air inlet 11 is at the right side of the bottom of the casing 1, while the air outlet 12 is at the left side of the bottom of the casing 1 in these embodiments.

Embodiment 1

Figure 2:
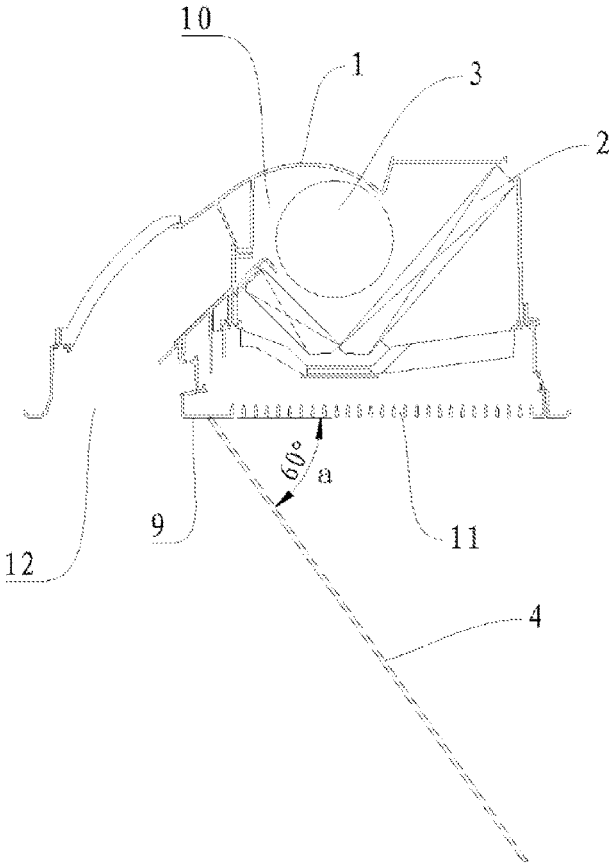
FIG. 2 is a schematic view of an indoor unit of an air conditioner according to an embodiment of the present disclosure, in which the panel is in an open position.

As shown in FIGS. 1 and 2, a casing 1 defines a receiving cavity 10 therein. An air inlet 11 and an air outlet 12 spaced apart from the air inlet 11 are formed in the bottom of the receiving cavity 10, and a spacing portion 9 is formed between the air inlet 11 and the air outlet 12. A heat exchanger 2 and a fan 3 are disposed in the receiving cavity 10. A panel 4 is disposed on the bottom of the casing 1 and movable between a close position and an open position.

Referring to FIG. 2, when the panel 4 is in the open position, the panel 4 is held in a position at which an angle α has a predetermined value. Specifically, the left end of the panel 4 abuts against the spacing portion 9 between the air outlet 12 and the air inlet 11, and the right end of the panel 4 is inclined downwards and forms a specific angle with respect to the lower surface of the bottom of the casing 1, in which the angle α between the plane in which the panel 4 lies and the horizontal plane in which the lower surface of the casing 1 lies ranges from 15° to 150°. In other words, when the plane 2 moves to a position with a determined angle α between the plane and the lower surface of the casing 1 and maintains the angle α, the angle α ranges from 15° to 150°. In the embodiment shown in FIG. 2, the angle α is 60°.

In the present embodiment, the driving device includes a first driving assembly 6 and a second driving assembly 7. The first driving assembly 6 is disposed between the panel 4 and the casing 1 so as to drive the panel 4 to translate to a predetermined position, i.e. the spacing position. The second driving assembly 7 is disposed between the panel 4 and the casing 1 so as to drive the panel 4 to make a clockwise rotation.

Figure 4:
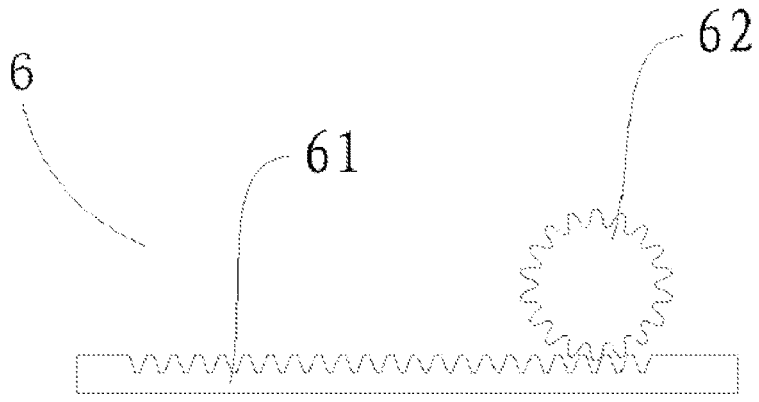
FIG. 4 is a schematic view of a first driving assembly of an indoor unit of an air conditioner according to an embodiment of the present disclosure.

In an example of an embodiment of the present disclosure, as shown in FIG. 4, the first driving assembly includes a first rack 61 and a first gear 62, the first rack 61 is disposed on the panel 4, the first gear 62 is disposed on the casing 1, and the panel 4 may translate with respect to the casing 1 under the meshing between the first rack 61 and the first gear 62. In another example of an embodiment of the present disclosure, the first driving assembly includes a driving belt pulley and a belt (not shown in the drawings), the driving belt pulley is disposed on the casing 1, and the belt cooperates with the driving belt pulley so as to drive the panel 4 to translate with respect to the casing 1.

Figure 5:
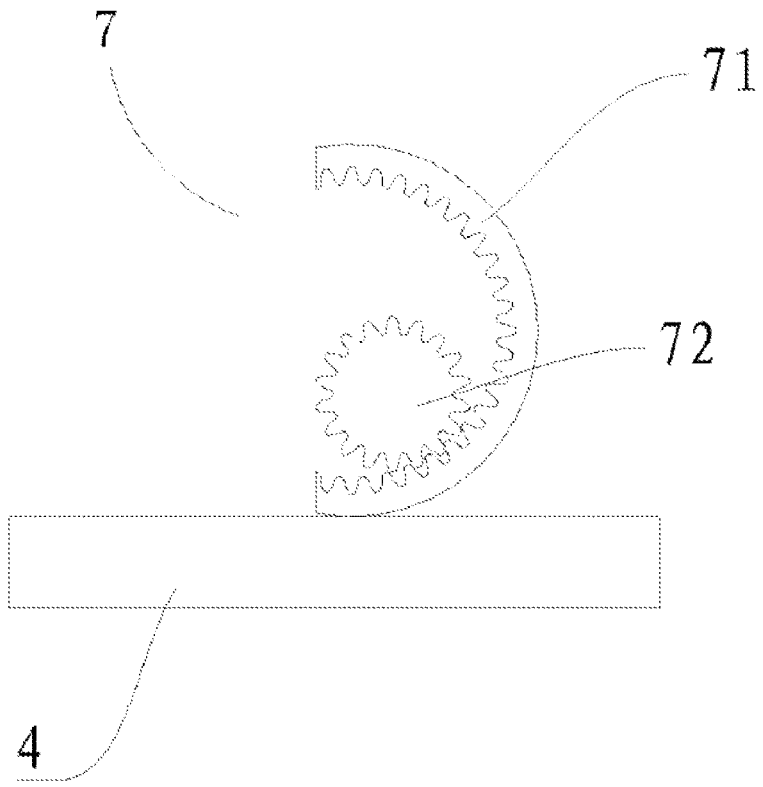
FIG. 5 is a schematic view of a second driving assembly of an indoor unit of an air conditioner according to an embodiment of the present disclosure.

In an example of an embodiment of the present disclosure, the second driving assembly includes an arc rack 71 and a second gear 72, the arc rack 71 is disposed on the panel 4, the second gear 72 is disposed on the casing 1, the second gear 72 meshes with the arc rack 71 so as to drive the panel 4 to rotate with respect to the casing 1, as shown in FIG. 5. In another example of an embodiment of the present disclosure, the second driving assembly includes a driving gear and a gear train (not shown in the drawings), the driving gear is disposed on the casing 1, the gear train is disposed on the panel 4, and the gear train meshes with the driving gear so as to drive the panel 4 to rotate with respect to the casing 1.

It is to be noted that, the first driving assembly and the second driving assembly in the examples mentioned above may be combined independently of each other, which are not limited to combinations in embodiments shown in the drawings.

With the indoor unit of the air conditioner according to embodiments of the present disclosure, by using the first driving assembly and the second driving assembly, the translation and rotation of the panel may be implemented efficiently and rapidly, and the indoor unit has a simple structure.

In some examples of an embodiment of the present disclosure, firstly the first driving assembly 6 drives the panel 4 to translate to the spacing position, and then the second driving assembly 7 drives the panel 4 to rotate to the open position and sway. Certainly, the present disclosure is not limited to this embodiment. In further embodiments of the present disclosure, the first driving assembly 6 drives the panel 4 to translate at the same time as the second driving assembly 7 drives the panel 4 to rotate.

Embodiment 2

Figure 6:
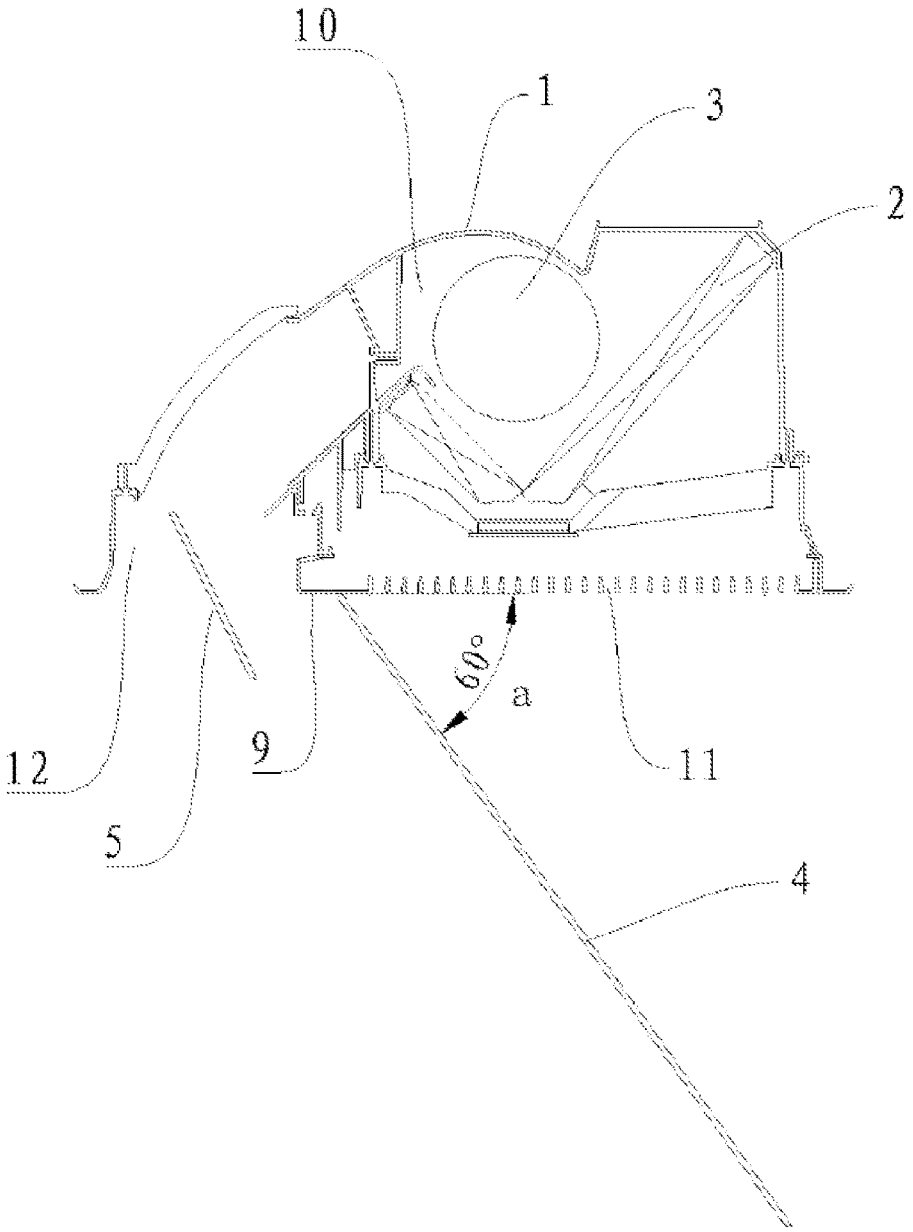
FIGS. 6-10 are schematic views of indoor units of an air conditioners according to some embodiments of the present disclosure, in which the panels are in open positions.
Figure 7:
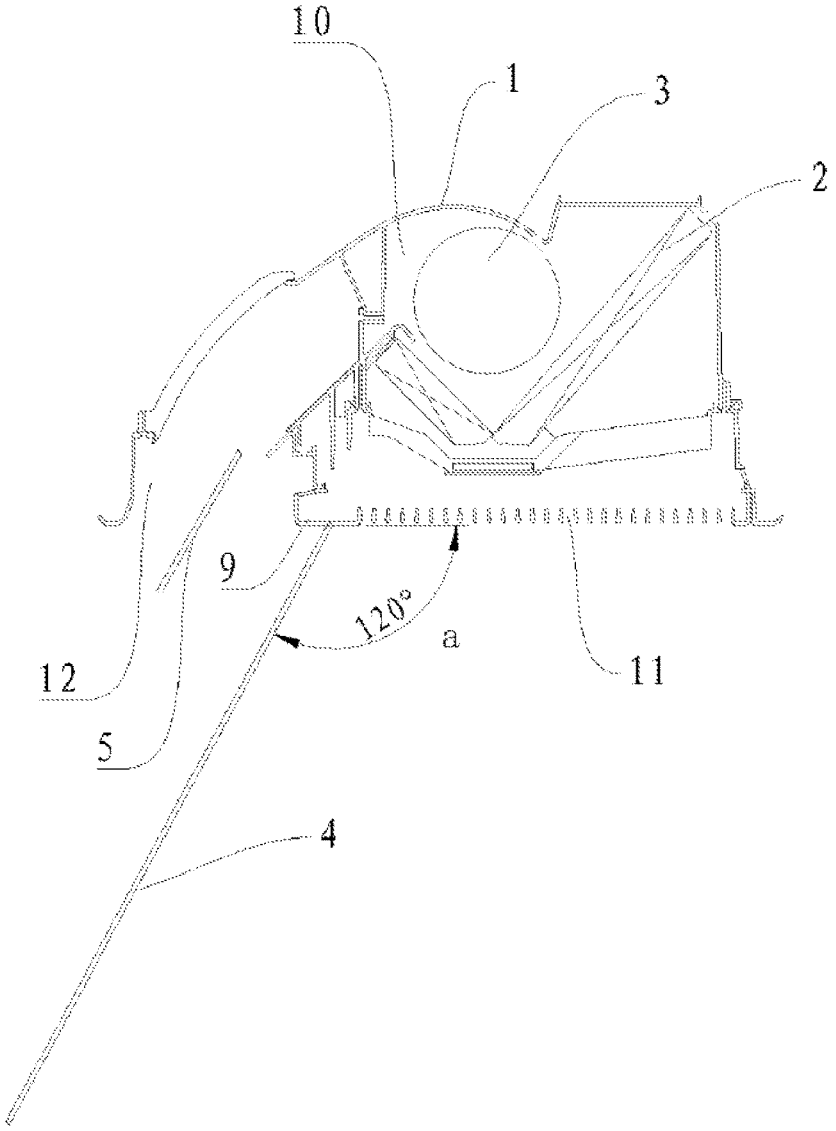

As shown in FIGS. 6 and 7, the present Embodiment 2 has a structure substantially the same as that in Embodiment 1, in which same components are labeled with the same reference numerals, and with following differences. First, an air guide 5 is disposed at the air outlet 12, and the air guide 5 cooperates with the panel 4 so as to adjust the air blowing direction. Secondly, when the panel 4 is in the open position, the panel 4 can sway within the range defined by the angle α. Specifically, referring to FIGS. 6 and 7, when the panel 4 is in the open position, the left end of the panel 4 abuts against the spacing portion 9 between the air outlet 12 and the air inlet 11, the right end of the panel 4 inclines downwards and sways, and the angle α between the plane in which the panel 4 lies and the horizontal plane in which the lower surface of the casing 1 lies ranges from 15° to 150°. In other words, the panel 4 can sway continuously within the angle range of 15° to 150° so as to adjust the air blowing angle and the air blowing range continuously.

Figure 8:
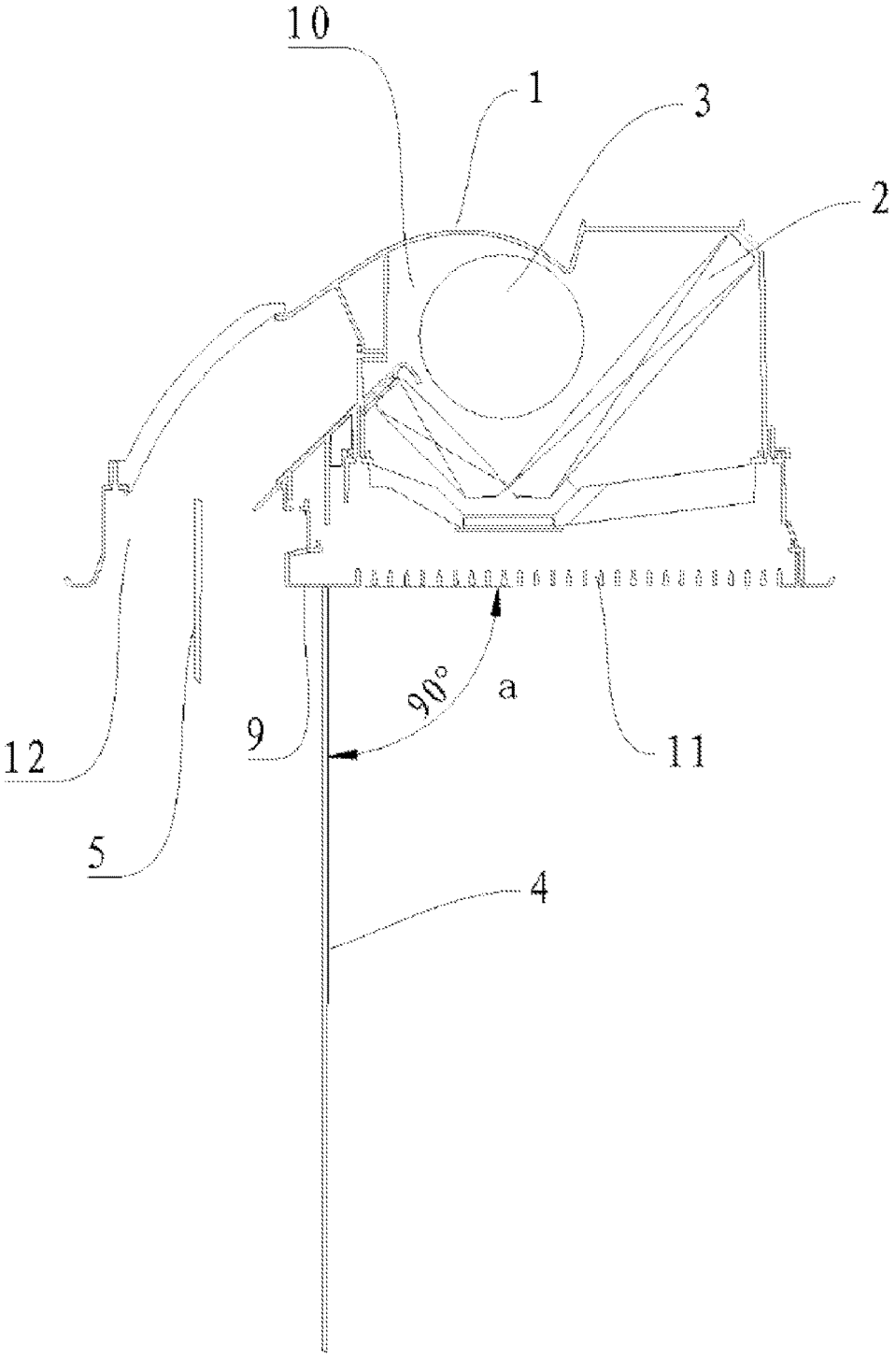

In an example of an embodiment of the present disclosure, as shown in FIG. 7, the air guide 5 guides the air to the right side, and the panel 4 rotates to the right so as to make the angle α being 60°. The angle between the air guide 5 positioned to direct to the air blowing direction and the horizontal direction are identical or similar to the angle α between the panel 4 and the lower surface of the casing 1, thus facilitating to blow cooled air discharged via the air outlet 12 to the right side. In another example, as shown in FIG. 8, the angle α between the panel 4 and the lower surface of the casing 1 is substantial 120°, and the air guide 5 guides the air to the left side and cooperates with the panel 4 so as to blow the cooled air discharged via the air outlet 12 to the left side.

In a case that the air guide 5 cooperates with the panel 4 to blow air, the angle α ranges from 40° to 140°. In this angle range, the cooperation between the air guide 5 and the panel 4 may realize blowing air to larger areas; meanwhile, the panel 4 prevents the blown air from diffusion, thus forming an air flow with a relatively higher flow rate along the panel 4. In this way, both the air blowing effect and flow guiding effect may be improved, and the blown air can be blown by a much further distance along the direction of the panel 4.

The driving device for driving the panel 4 is similar to that in the above embodiment, thus details thereof are omitted herein.

Embodiment 3

Figure 9:
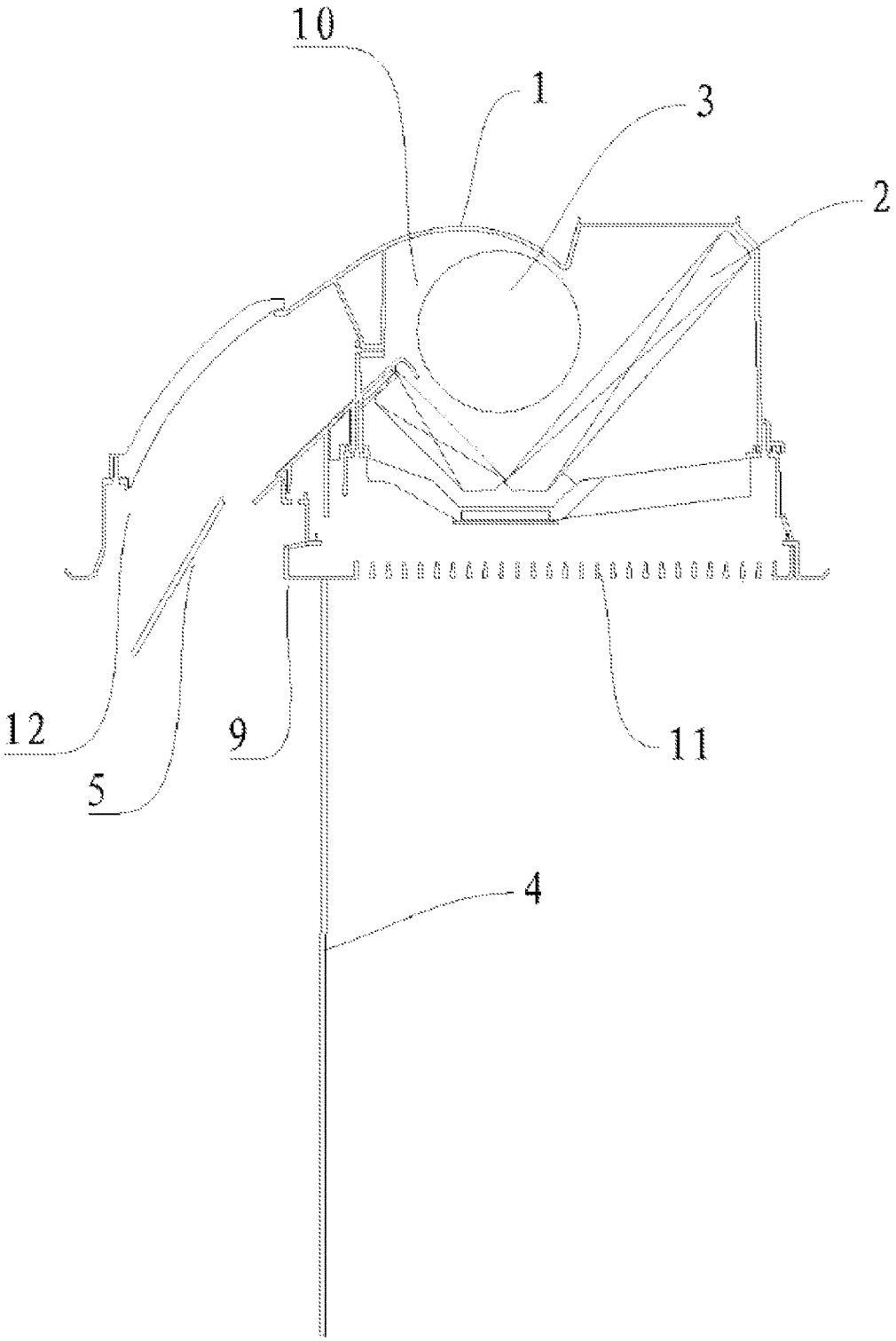

As shown in FIGS. 8 and 9, the present Embodiment 3 has a structure substantially the same as that in the Embodiment 2, in which the same components are labeled with the same reference numerals, and with the following differences. Referring to FIGS. 8 and 9, when the panel 4 is in the open position, the panel 4 is held in a position at which the angle α has a predetermined value. In embodiments shown in FIGS. 8 and 9, the angle α is 90°, i.e. the panel 4 guides the air blown out via the air outlet 12 to move vertically downwards.

The air guide 5 disposed at air outlet 12 cooperates with the panel 4 so as to adjust the air blowing direction. As shown in FIG. 8, the air guide 5 guide the air down, and the panel 4 is held in a position at which the angle α is 90°. As shown in FIG. 9, the air guide 5 guides the air to the left side, and the panel 4 is held at the position at which the angle α is 90°.

This embodiment is often used in the heating operation. Due to the need of blowing heated air to the bottom area of a room so as to improve a comfort provided by this room, it is more relied on the guide effect of the panel 4. When the angle α ranges from 75° to 120°, the heated air can be better delivered downwards. In this angle range, the panel 4 cooperates with the air guide 5, and thereby realizing blowing heated air to areas where users locate.

The driving device for driving the panel 4 is similar to that in the above embodiment, thus details thereof are omitted herein.

Embodiment 4

Figure 10:
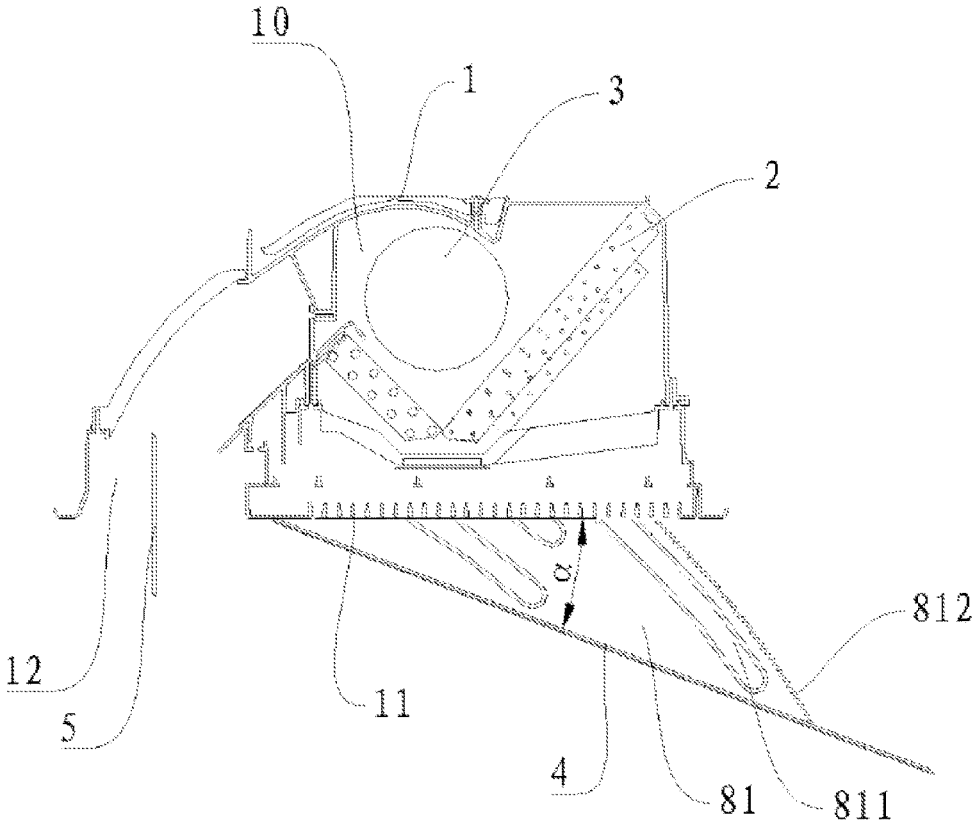

As shown in FIG. 10, referring in combination to FIG. 11, the present Embodiment 4 has a structure substantially the same as that in Embodiment 1, in which the same components are labeled with the same reference numerals, and with several differences in the structure of the driving device.

In the present embodiment, the driving device includes a guide plate 81 and a slider 82, the guide plate 81 is connected to the panel 4 and has an arc sliding passage 811 therein, and the slider 82 is disposed on the casing and slidable in the arc sliding passage 811 so as to define a movement track of the guide plate 81 and drive the panel 4 to move between the close position and the open position.

Further, as shown in FIG. 11, an outer gear rim 812 is formed at an outer edge of the guide plate 81, the driving device further includes a driving gear 83, and the driving gear 83 is disposed on the casing 1 to mesh with the outer gear rim 812. The panel 4 is movable between the close position and the open position under the cooperation between the slider 82 and the arc sliding passage 811 and the cooperation between the driving gear 83 and the outer gear rim 812. When the air conditioner is operating, the driving gear 83 drives the guide plate 81 to move downwards, and thereby driving the panel 4 to move downwards. When the air conditioner is turned off, the driving gear 83 rotates in reverse, such that the guide plate 81 moves back to the original position, such that the air inlet 11 and the air outlet 12 are closed by the panel 4.

The driving device of the indoor unit according to embodiments of the present disclosure is simple and useful, may provide reliable movements, and may drive the panel to a position at which the angle α has a predetermined value.

In the present embodiment, the air conditioner is operating with small air volume. In the small air volume operating mode, a flow rate of air at the air inlet and a flow rate of air at the air outlet are relatively lower. In order to further reduce air blowing noises and realizing blowing air to a relatively larger area, the angle α ranges from 75° to 15° in this mode. In such case, user requirements such as small air volume and low noises can be satisfied.

Embodiment 5

As shown in FIG. 11, same components are labeled with same reference numerals in the present Embodiment 5 and Embodiment 4, the present Embodiment 5 differs from Embodiment 4 in that Embodiment 5 is an indoor unit including two indoor units of Embodiment 4 combined in mirror symmetry at the air outlet side.

In other words, the casing defines two symmetry receiving cavities 10, and two heat exchangers 2, two fans 3 and two panels 4 are provided. As shown in FIG. 11, an air inlet 11 and an air outlet 12 spaced apart from the air inlet 11 are disposed in the bottom of each receiving cavity 10, the two heat exchangers 2 are disposed in the receiving cavities 10 respectively, the two fans 3 are disposed in the receiving cavities 10 respectively, and the two panels 4 are disposed symmetrically on the bottom of the casing 1. Every panel 4 is movable between a close position in which one corresponding air inlet 11 and one corresponding air outlet 12 are both closed by the panel 4 and an open position in which the one corresponding air inlet 11 and the one corresponding air outlet 12 are both open. The panels 4 are driven by two driving devices described in Embodiment 4 respectively.

As shown in FIG. 11, when the air conditioner is operating, two driving gears 83 drive corresponding guide plates 81 to move downwards respectively and the sliders 82 slide in corresponding arc sliding passages 811, so as to drive corresponding panels 4 to rotate to positions in which each of the angles α corresponding to the two panels has a predetermined value, and opposing ends of the two panels 4 abut against the spacing portion 9 between the air inlet 11 and the air outlet respectively.

Similar to Embodiment 4, in the present Embodiment 5, the indoor unit of the air conditioner is operating with small air volume. In the small air volume operating mode, flow rates of air at the air inlet and at the air outlet are both relatively lower. In order to further reduce air blowing noises and to blow air to a larger area, the angle α ranges from 75° to 15° in this mode. In such case, requirements of users such as small air volume and low noise can be satisfied.

With the indoor unit of the air conditioner according to embodiments of the present disclosure, by using the driving device to drive the panel 4, the panel 4 may be held at the spacing portion 9 between the air outlet 12 and the air inlet 11, with the angle α having a predetermined value. The present disclosure provides following advantages: 1) with the panel closing the air inlet and the air outlet when the indoor unit is not operating, providing the indoor unit an aesthetic appearance and avoiding dusts from entering the interior of the indoor unit; 2) preventing the cooled air or heated air from returning to the indoor unit and mixing with the intake air, and avoiding a loss of the cooling capacity or the heating capacity; 3) realizing a better air blowing effect under the cooperation of the air guide; and 4) improving the speed of blowing air downwards and the static pressure in the heating operation.

Various operation modes, such as a cooling mode, a heating mode and a small air volume mode, are well known to those with ordinary skill in the art, and thus details thereof are omitted herein. In addition, other components (for example, the heat exchanger and the fan) of the indoor unit of the air conditioner and operations thereof are known to those with ordinary skill in the art, and thus details thereof are also omitted herein.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments can not be construed to limit the present disclosure, and changes, alternatives, and modifications can be made in the embodiments without departing from spirit, principles and scope of the present disclosure.

What is claimed is:

1. An indoor unit of an air conditioner, comprising:

a casing defining a receiving cavity therein and having a spacing portion, the receiving cavity having an air inlet and an air outlet formed in a bottom of the receiving cavity and spaced apart from each other by the spacing portion;

a heat exchanger disposed in the receiving cavity and adjacent to the air inlet so as to perform heat exchanging with an air flow entering the receiving cavity via the air inlet;

a fan disposed in the receiving cavity; and a panel disposed on a bottom of the casing and movable between a close position, a spacing position, and an open position, wherein in the close position, the panel closes both the air inlet and the air outlet, wherein in the open position, the panel opens both the air inlet and the air outlet, and at least partially separates air entering via the air inlet from air exiting via the air outlet;

wherein in the open position, a first end of the panel abuts against a lower surface of the spacing portion, a second end of the panel is inclined downwards, and an angle a between a plane in which the panel lies and a horizontal plane in which a bottom surface of the casing lies ranges from 15° to 150°;

wherein the panel is swayable within a range defined by the angle $\alpha$;

wherein the panel is configured to translate towards the air inlet from the close position to the spacing position, then to rotate to the open position.

2. The indoor unit of an air conditioner according to claim 1, wherein the angle $\alpha$ between the plane in which the panel in the open position lies and the horizontal plane in which the bottom surface of the casing lies ranges from 40° to 140° when the air conditioner is in a heating operation.

3. The indoor unit of an air conditioner according to claim 1, wherein the angle $\alpha$ between the plane in which the panel in the open position lies and the horizontal plane in which the bottom surface of the casing lies ranges from 15° to 75° when the air conditioner is operating with small air volume.

4. The indoor unit of an air conditioner according to claim 1, wherein the panel is held in a position at which the angle $\alpha$ has a predetermined value when the panel is in the open position.

5. The indoor unit of an air conditioner according to claim 1, further comprising an air guide swayably disposed at the air outlet and configured to guide the air exiting via the air outlet.

6. The indoor unit of an air conditioner according to claim 1, further comprising a driving device disposed between the panel and the casing and configured to drive the panel to move between the close position and the open position.

7. The indoor unit of an air conditioner according to claim 6, wherein the driving device comprises:

a first driving assembly disposed between the panel and the casing and configured to drive the panel to translate to a predetermined position, and a second driving assembly disposed between the panel and the casing and configured to drive the panel to rotate.

8. The indoor unit of an air conditioner according to claim 7, wherein the first driving assembly comprises:

a first rack disposed on the panel, and a first gear disposed on the casing and configured to mesh with the first rack so as to drive the panel to translate with respect to the casing.

9. The indoor unit of an air conditioner according to claim 8, wherein the second driving assembly comprises:

an arc rack disposed on the panel, and a second gear disposed on the casing and configured to mesh with the arc rack so as to drive the panel to rotate with respect to the casing.

10. The indoor unit of an air conditioner according to claim 9, wherein the second driving assembly drives the panel to rotate at the same time as the first driving assembly drives the panel to translate.

11. The indoor unit of an air conditioner according to claim 7, wherein the first driving assembly comprises:

a driving belt pulley disposed on the casing, and a belt configured to cooperate with the driving belt pulley so as to drive the panel to translate with respect to the casing.

12. The indoor unit of an air conditioner according to claim 11, wherein the second driving assembly comprises:

a driving gear disposed on the casing, and a gear train disposed on the panel and configured to mesh with the driving gear so as to drive the panel to rotate with respect to the casing.

13. The indoor unit of an air conditioner according to claim 12, wherein the second driving assembly drives the panel to rotate at the same time as the first driving assembly drives the panel to translate.

14. The indoor unit of an air conditioner according to claim 6, wherein the driving device comprises:

a guide plate connected to the panel and having an arc sliding passage therein, and a slider disposed on the casing and slidable in the arc sliding passage so as to define a movement track of the guide plate and to drive the panel to move between the close position and the open position.

15. The indoor unit of an air conditioner according to claim 14, wherein an outer gear rim is formed at an outer edge of the guide plate;

the driving device further comprises a driving gear disposed on the casing and configured to mesh with the outer gear rim; and the panel is moveable between the close position and the open position under cooperation between the slider and the arc sliding passage and cooperation between the driving gear and the outer gear rim.

16. The indoor unit of an air conditioner according to claim 1, wherein the casing defines two symmetry receiving cavities therein, each receiving cavity has an air inlet and an air outlet spaced from each other and formed in the bottom of the receiving cavity; and the indoor unit comprises two heat exchangers disposed in the two receiving cavities respectively, two fans disposed in the two receiving cavities respectively, at least two panels disposed symmetrically on the bottom of the casing, and each panel is movable between a close position in which one corresponding air inlet and one corresponding air outlet are both closed by the panel and an open position in which the one corresponding air inlet and the one corresponding air outlet are both open.

17. The indoor unit of an air conditioner according to claim 1, wherein the receiving cavity comprises one air outlet, the indoor unit comprises one panel, and an end of the panel abuts against a spacing portion between the air inlet and the air outlet when the panel is in the spacing position.

18. The indoor unit of an air conditioner according to claim 1, wherein the receiving cavity comprises a plurality of air outlets disposed at least two ends of the bottom of the casing; and the indoor unit comprises a plurality of panels, each panel is disposed on the bottom of the casing and between one corresponding air outlet and one corresponding air inlet, the air inlet and the air outlets are closed by the panels respectively when the panels are in the close positions, and the air inlet and the air outlets are opened by the panels respectively when the panels are in the open positions.

19. An indoor unit of an air conditioner, comprising:

a casing defining a receiving cavity therein, the receiving cavity having an air inlet and an air outlet formed in a bottom of the receiving cavity and spaced apart from each other;

a heat exchanger disposed in the receiving cavity and adjacent to the air inlet so as to perform heat exchanging with an air flow entering the receiving cavity via the air inlet;

a fan disposed in the receiving cavity; and a panel disposed on a bottom of the casing and movable between a close position and an open position, wherein in the close position, the panel closes both the air inlet and the air outlet;

a driving device disposed between the panel and the casing and configured to drive the panel to move between the close position and the open position;

wherein in the open position, the panel opens both the air inlet and the air outlet, and at least partially separates air entering via the air inlet from air exiting via the air outlet;

wherein the driving device comprises:

a first driving assembly disposed between the panel and the casing and configured to drive the panel to translate towards the air inlet from the close position to a predetermined position, and a second driving assembly, independent of the first driving assembly, disposed between the panel and the casing and configured to drive the panel to rotate to the open position.

* * * * *